US006772699B1

(12) United States Patent
Elliott

(10) Patent No.: US 6,772,699 B1
(45) Date of Patent: Aug. 10, 2004

(54) FOLDING PICNIC TABLE

(75) Inventor: John M. Elliott, Edina, MN (US)

(73) Assignee: Sico Incorporated, Edina, MN (US)

( * ) Notice: Subject to any disclaimer, the term of this patent is extended or adjusted under 35 U.S.C. 154(b) by 0 days.

(21) Appl. No.: 10/437,724

(22) Filed: May 13, 2003

(51) Int. Cl.[7] ..... A47B 39/00; A47B 3/00; A47B 3/06

(52) U.S. Cl. ..... 108/115; 297/158.3; 297/158.4; 297/158.5

(58) Field of Search ..... 297/158.3, 158.4, 297/158.5; 108/115

(56) References Cited

U.S. PATENT DOCUMENTS

| | | | |
|---|---|---|---|
| 1,924,945 | A | 8/1933 | Klotz |
| 2,771,937 | A | 11/1956 | Wilson |
| 2,782,075 | A | 2/1957 | Fagan |
| 3,028,197 | A | 4/1962 | Wilson |
| 3,099,480 | A | 7/1963 | Wilson |
| 3,877,086 | A | 4/1975 | Bue et al. |
| 3,900,905 | A | 8/1975 | Johnson et al. |
| 3,999,245 | A | 12/1976 | Bue et al. |
| 4,100,858 | A | 7/1978 | Bue et al. |
| 4,136,622 | A | 1/1979 | Bue et al. |
| D257,623 | S | 12/1980 | Bue et al. |
| 4,337,670 | A | 7/1982 | Carlson |
| 4,449,263 | A | 5/1984 | Wilson et al. |
| 4,592,105 | A | 6/1986 | McNamara |
| 4,793,011 | A | 12/1988 | Eve |
| 4,885,813 | A | 12/1989 | McNamara |
| D327,779 | S | 7/1992 | Jensen et al. |
| 5,446,932 | A | 9/1995 | Voorhis |
| 5,522,097 | A | 6/1996 | Ciccotelli |
| 5,652,978 | A | 8/1997 | Wiig |
| 5,906,015 | A | 5/1999 | Hilger et al. |
| D413,734 | S | 9/1999 | Bue |
| 6,212,710 | B1 | 4/2001 | Jones |

OTHER PUBLICATIONS

Photographs of folding picnic table (admitted prior art).

*Primary Examiner*—Peter M. Cuomo
*Assistant Examiner*—Sarah C. Burnham

(57) ABSTRACT

A folding picnic table has a frame including folding legs. The frame supports a tabletop and a bench extending along each side of the tabletop. The picnic table folds between a use position and a storage position with the benches folded onto the tabletop and tipped onto one side on a caster assembly. The table includes a locking device, automatically locking the seating structures to the tabletop at a partially tipped position; and automatically releasing the legs when the table is tipped to a storage position. The frame also includes a retainer plate that keeps the frame from accidentally folding when the benches are folded onto the tabletop for cleaning under the table or during tipping of the table to a storage position.

12 Claims, 8 Drawing Sheets

FOLDING PICNIC TABLE

BACKGROUND OF THE INVENTION

1. Field of the Invention

The present invention is directed to a folding table and in particular, to a folding picnic table having an improved lock system for the legs and benches to facilitate folding and unfolding and to prevent inadvertent folding of the legs when the table benches are folded against the tabletop.

2. Description of the Prior Art

Picnic tables are commonly used at outdoor settings for providing a casual dining atmosphere. Picnic tables typically include a table portion with two benches, one bench extending along each side. Some picnic tables include a framework that supports both the benches and the tabletop as a single assembly. Although picnic tables provide a lightweight seating and table option, other improvements have been made. Some picnic tables have provided for folding of the benches and table to a narrow storage position so that the picnic table requires less space when not in use.

To further improve the utility of folding picnic tables, rollers or casters have been added to provide easier mobility. This improves the usefulness of the tables and allows for easier conversion of the spaces in which the tables are set up for other uses. Such caster assemblies provide for easy mobility of the table while allowing the table to fold up to a narrow profile that still provides for nesting. Although such tables have proven to be very successful in providing a table top with seating that is easily mobile while also having fast setup and breakdown time, further improvements are possible.

Although the prior folding picnic tables do provide excellent mobility and utility, such folding tables do have some drawbacks. Folding of the table between the upright storage position and the unfolded use position can be cumbersome. Maintaining the table benches folded against the top of the tabletop requires coordination during folding and unfolding and the task can be cumbersome. To provide smoother and easier folding, it would be advantageous to have the benches and table legs locked during portions of the folding motion. Such locking is improved if engagement and disengagement is automatic. Moreover, utility is improved if the locking devices are positioned such that they do not impede the utility of the table or benches and are located in such a manner that the devices do not provide structure that may catch on users' clothing or otherwise limit the use of the table. Even more difficulties may arise to position the locking devices such that they are functional, yet do not impinge the folding mechanism of the table.

It can be seen then that a new and improved folding picnic table assembly is needed. Such a picnic table provides for folding of the benches and legs from a use position to a storage position and provides casters for moving the folded table. In addition, such a table should provide for nesting of the tables when folded. Such tables should have locks that maintain the benches and legs at a predetermined position to facilitate easier folding of the table. The present invention addresses these as well as other problems associated with folding picnic tables.

SUMMARY OF THE INVENTION

The present invention is directed to a folding picnic table assembly, and in particular, to a folding picnic table with latches that retain the benches and folding legs at preferred positions to improve stability of the table while folding and unfolding.

The folding picnic table of the present invention includes a tabletop with legs and benches extending along two opposed sides of the tabletop. The picnic table folds between a use position and a storage position wherein the benches are folded onto the table top,the table is tipped onto its side and supported on a caster assembly and the legs are folded to an underside of the table top. The picnic table has a narrow profile in its storage position and can be nested with other tables and easily rolled on its casters.

To ensure that the benches do not fall when the table is being tipped onto its side, a latch assembly is provided that engages when the benches are folded up and onto the tabletop. The latch assembly automatically engages and latches to prevent the benches from falling during the folding operation. The latch assembly includes two engagement members that are pivotally mounted, one to each bench. The engagement members include hook-type ends that latch as the table is tipped. The latches include upper and lower hook-type portions on each member so that the engagement is automatic regardless of which of the benches is first moved to the top of the tabletop. The hook portions engage one another as the table is being tipped to one side to prevent the benches from pivoting and falling back to the use position. When the tabletop is fully tipped to its vertical storage position, the latch assembly disengages. The upper bench is held by gravity while the lower bench is held by the caster assembly. Moreover, the latch is automatically disengaged when the table is tipped back to the use position with the tabletop horizontal. When the table is unfolded to the use position, the latch members hang downward and are recessed below the underside of the benches in an out of the way location so that users do not accidentally hit the latch assembly.

In addition to securing the benches during folding, it is advantageous to hold the folding leg portions of the frame in an extended position at the table's use position and during folding so that the legs cannot collapse. To prevent collapse, the frame includes a pivoting retainer plate that engages the folding legs in the unfolded use position. The plate is supported so that it automatically pivots to a retracted position when the picnic table is tipped on its side. With the plate pivoted to the retracted position, the legs may be freely folded against the underside of the table. When the table is tipped back to its use position, the plates automatically return to their engagement position and prevent the legs from collapsing when in use. The leg lock provides for stable support for the picnic table with the top in the horizontal use position regardless of whether the benches are in the use position or folded onto the tabletop, but sill provides for storing the table in a minimal amount of space when folded.

These features of novelty and various other advantages that characterize the invention are pointed out with particularity in the claims annexed hereto and forming a part hereof. However, for a better understanding of the invention, its advantages, and the objects obtained by its use, reference should be made to the drawings, which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
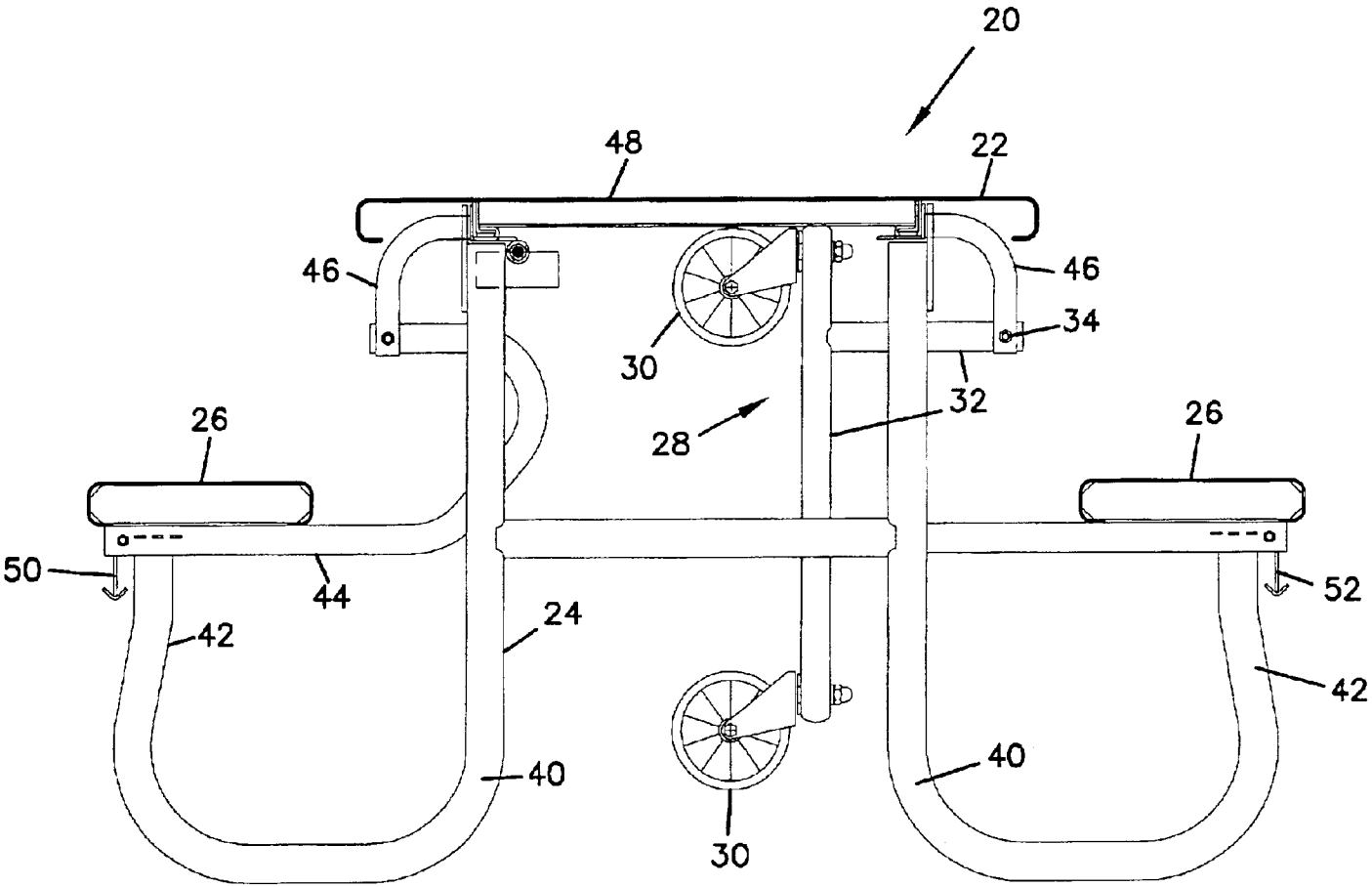
FIG. 1 is an end view of the folding picnic table according to the principles of the present invention in an unfolded use position.
Figure 2:
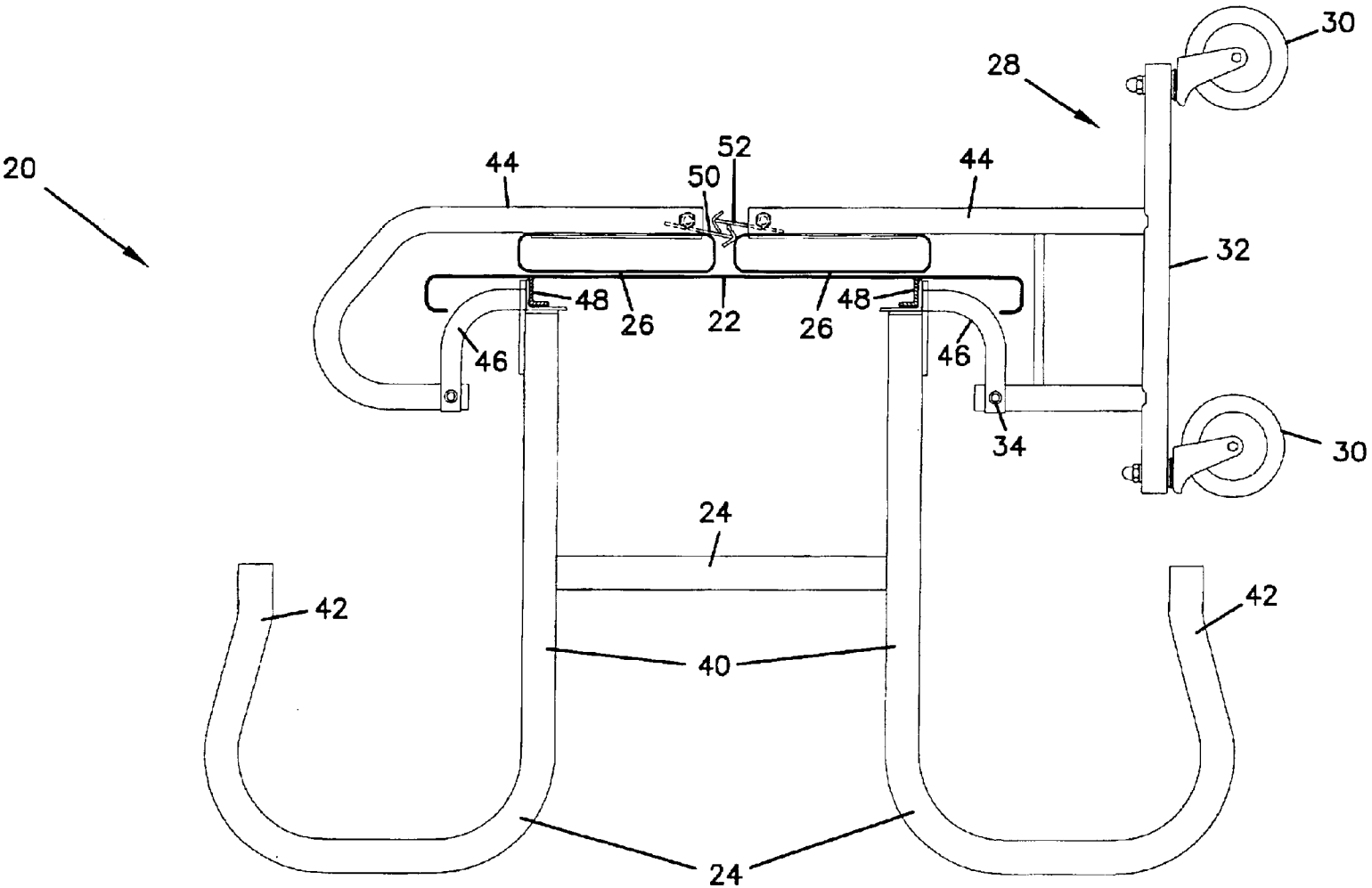
FIG. 2 is an end view of the folding picnic table shown in FIG. 1 in a partially folded position.
Figure 3:
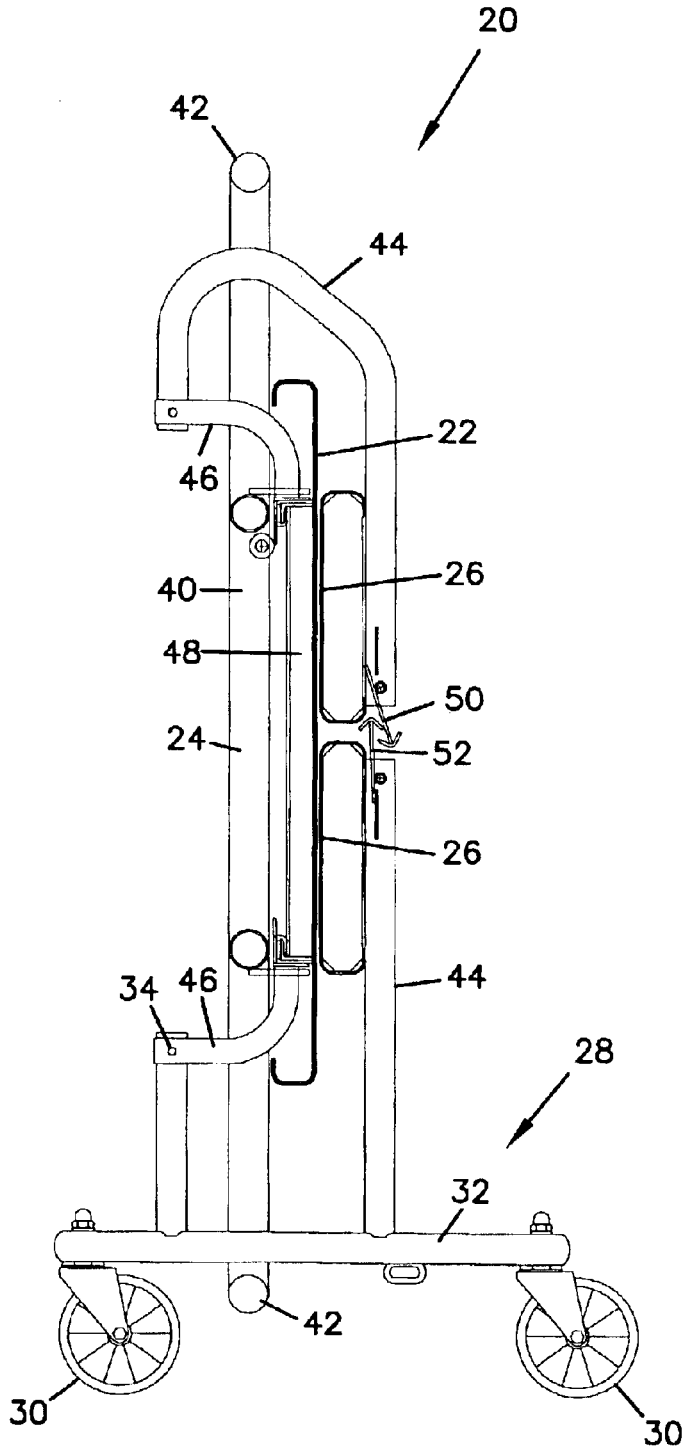
FIG. 3 is an end view of the folding picnic table shown in FIG. 1 in a folded storage position.

Referring to the drawings, and particular to FIGS. 1–5, there is shown a folding picnic table, generally designated 20. The picnic table includes a supporting framework 24 and a tabletop 22. The picnic table 20 folds from a use position shown in FIG. 1 to a position where it is tipped on its side and rests on a caster assembly 28, as shown in FIG. 2, to a folded storage position, as shown in FIG. 3. As the folding picnic table may be exposed to the elements, the tabletop 22 and benches 26 may have a grate-like configuration or have other openings formed therein to allow water to pass through for easier cleaning and to decrease weight. The benches 26 and tabletop 22 may have a weatherproof coating applied to the surface or otherwise be treated to minimize rust or other corrosion.

Referring again to FIGS. 1–4, the framework 24 includes tabletop leg portions 40 extending downward from the underside of the tabletop. The leg portions 40 are pivotally connected to the tabletop 22 and a tabletop frame 48 so that the table 20 may be folded from the use position shown in FIGS. 1 and 2 to the storage position shown in FIG. 3, wherein the frame assembly 24 is folded to a position substantially against the underside of the tabletop 22. As explained hereinafter, the framework includes a locking mechanism to prevent accidental folding of the framework 24 while in use or during the tipping operation.

The benches 22 are supported by vertical support portions 42 extending upward to engage the underside of the benches. The framework 24 includes generally rounded corner portions leading to a vertical portion extending up to an underside of the bench to facilitate easier tipping and to maintain greater contact with the floor or ground during the tipping operation.

Figure 4:
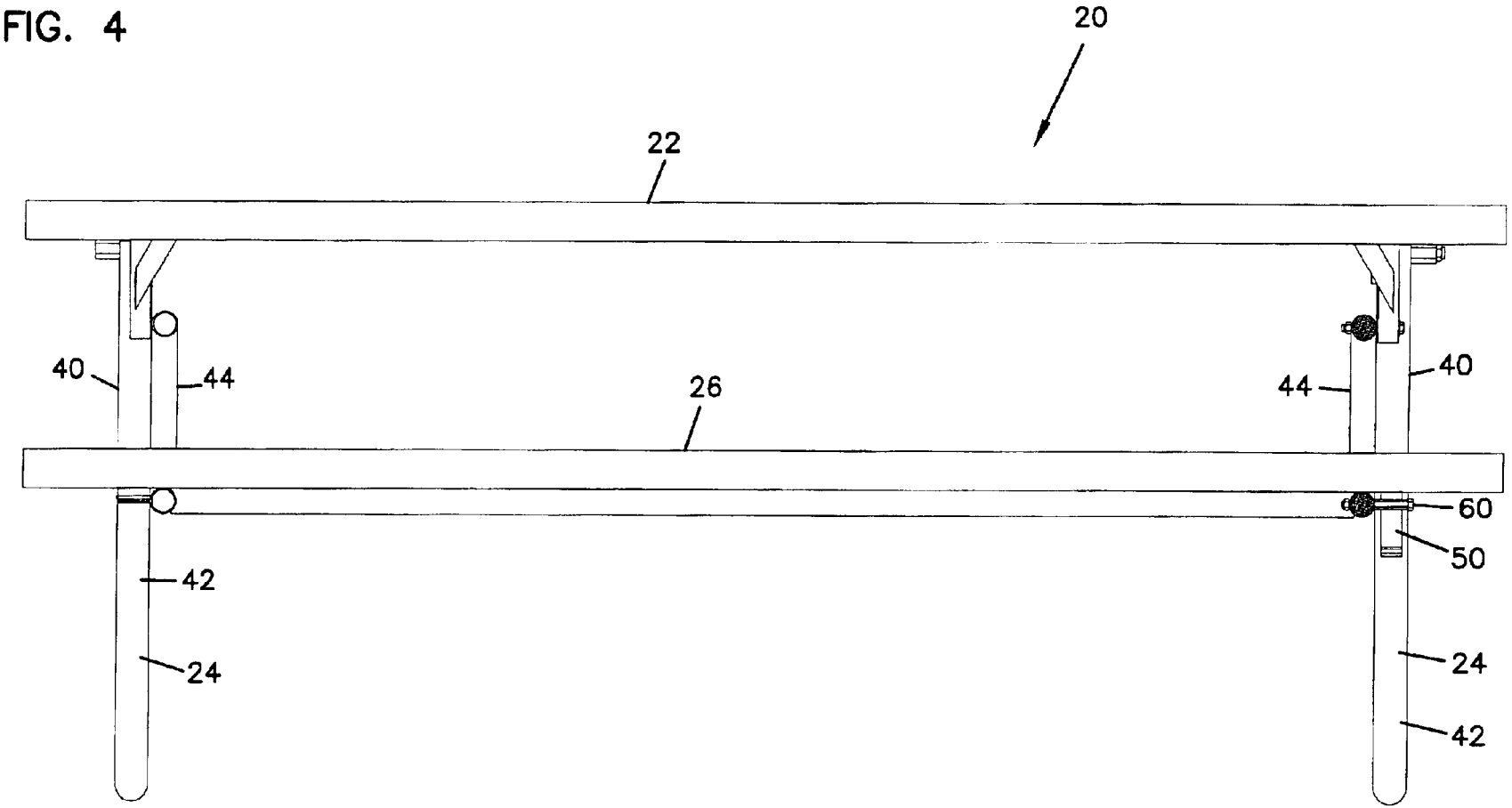
FIG. 4 is a side view of the folding picnic table shown in FIG. 1 is an unfolded use position with the caster assembly omitted for clarity.
Figure 5:
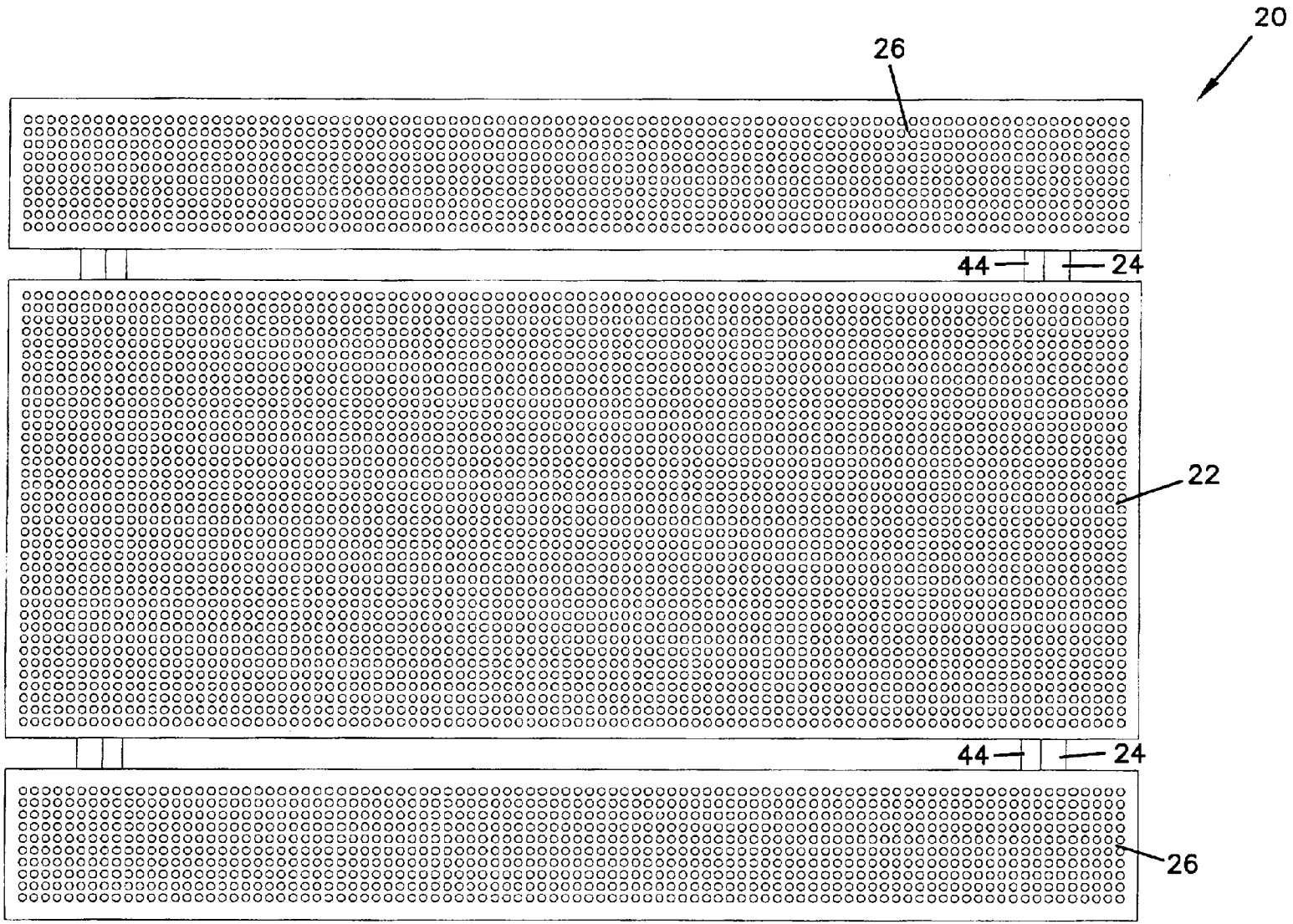
FIG. 5 is a top plan view of the folding picnic table shown in FIG. 1 is an unfolded use position with the caster assembly omitted for clarity.

The benches 26 also pivot for folding from the use position show in FIGS. 1, 4 and 5 to the folded storage position shown in FIGS. 2 and 3. The benches 26 include framework support members 44 attached to a mounting member 46 extending downward from below the tabletop 22. One of the benches, the right bench as viewed in FIGS. 1 and 2, also has the caster assembly 28 on its framework 44, which is pivotally mounted to the support members 46. For storage, the benches 26 are pivoted from their use position shown in FIG. 1, wherein they engage the supports 42, to a position on top of the tabletop 22, as shown in FIGS. 2 and 3. With this folding configuration, the table 20 has a much narrower and more compact profile for storage. This configuration also provides for nesting of adjacent tables so that much less space is required to store the tables 20. The benches 26 also include locks, as explained hereinafter to maintain the benches against the tabletop 22 while the table 20 is being tipped to its side.

As shown in FIGS. 1–3, the caster or roller assembly 28 includes a frame 32 that includes bench support member 44 and supports one the benches 26. The caster assembly 28 mounts to support member 46 at the underside of the tabletop 22 at a pivot 34. Each of the caster assemblies 28 includes two rollers or casters 30 that provide easy rolling transport of the table 20.

Figure 6:
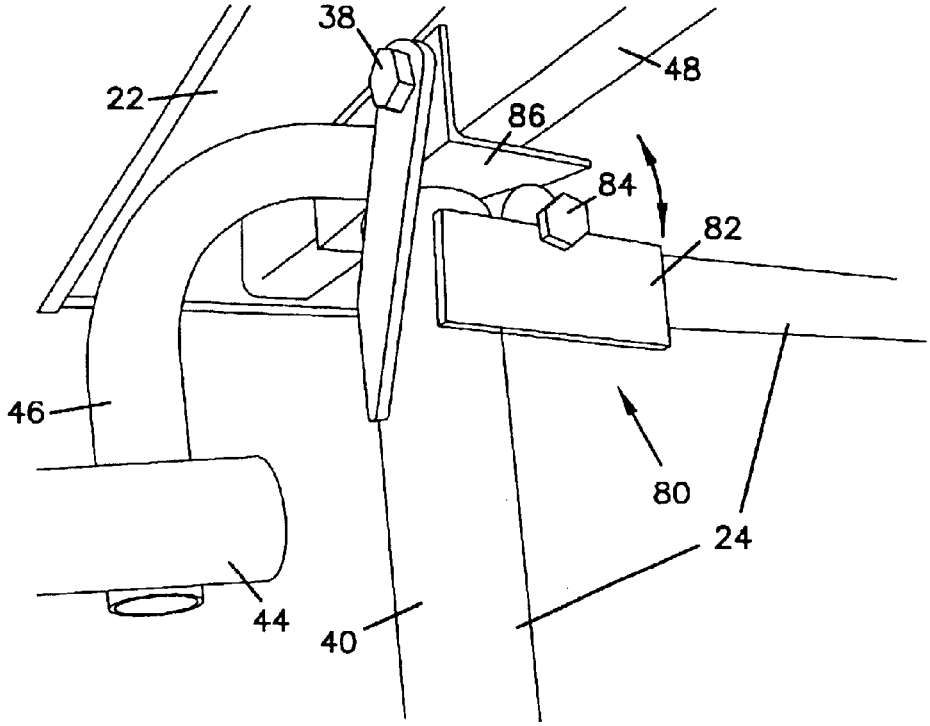
FIG. 6 is a detail view of a leg lock for the folding picnic table shown in FIG. 1 in an unfolded use position.
Figure 7:
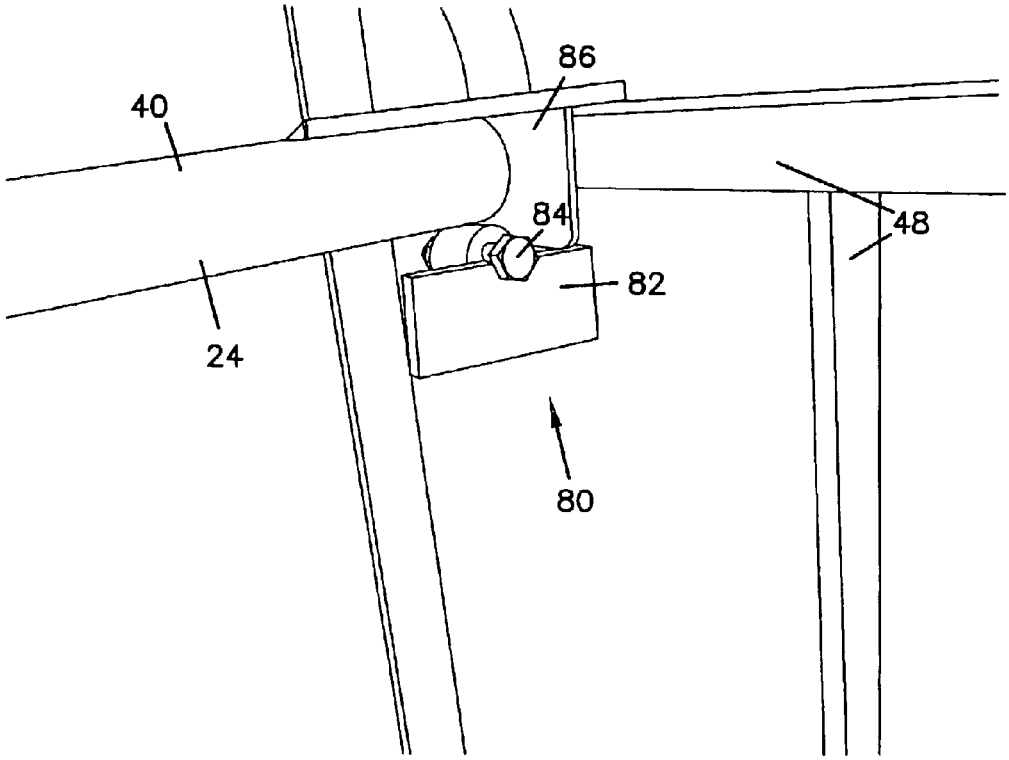
FIG. 7 is a detail view of the leg lock shown in FIG. 6 with the table in a folded storage position.

Referring now to FIGS. 6 and 7, there is shown a detail of a frame lock device, generally designated 80. The lock device 80 mounts to the framework 48 for the tabletop 22. The lock device 80 includes a retaining member 82 in the form of a plate. In the use position as shown in FIG. 6, the plate 82 engages the tabletop leg portions 40 of the framework 24. At this position, the leg 40 cannot rotate about a pivot 38 on the tabletop frame 48 as the plate 82 blocks movement. However, when the table is tipped to one side, the leg 40 does not engage the retainer plate 82. The retainer plate 82 remains with its longitudinal axis extending substantially horizontally as the table 20 is tipped by rotating about a pivot 84 until it engages a stop 86. Therefore, the tabletop leg portions 40 of the frame are not retained, as shown in FIG. 7, and may be freely pivoted to the storage position shown in FIG. 3. The retainer member 82 automatically re-engages the tabletop leg portions 40 as the table 20 is being tipped back to the use position shown in FIG. 1. The retainer member 82 engages the leg portion 40 of the frame while in use and during tipping to prevent accidental collapse of the framework and enhances stability. In addition, the locking mechanism 80 automatically engages and disengages through gravity during the tipping operations between the use and storage positions. Although support and stability is provided by the retainer members 82 engaging the tabletop leg portions 40, the present invention provides further support and stability with the bench framework support members 44 engaging the tabletop leg portions 40 when the benches 26 are in the use position, as shown in FIG. 1.

Figure 8:
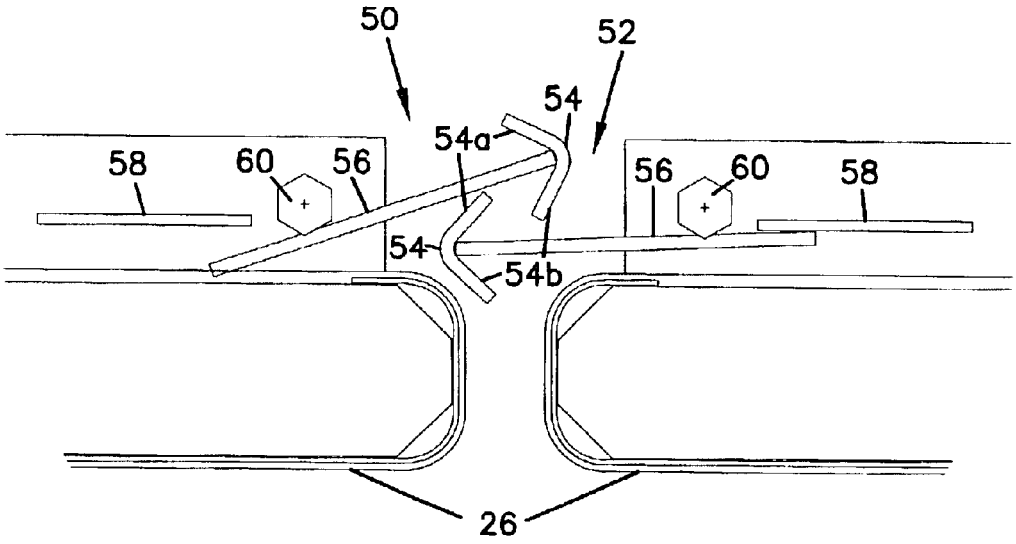
FIG. 8 is a detail view of the bench lock for the table shown in FIG. 1 with the benches folded on the table and a first engagement member covering a second engagement member.
Figure 9:
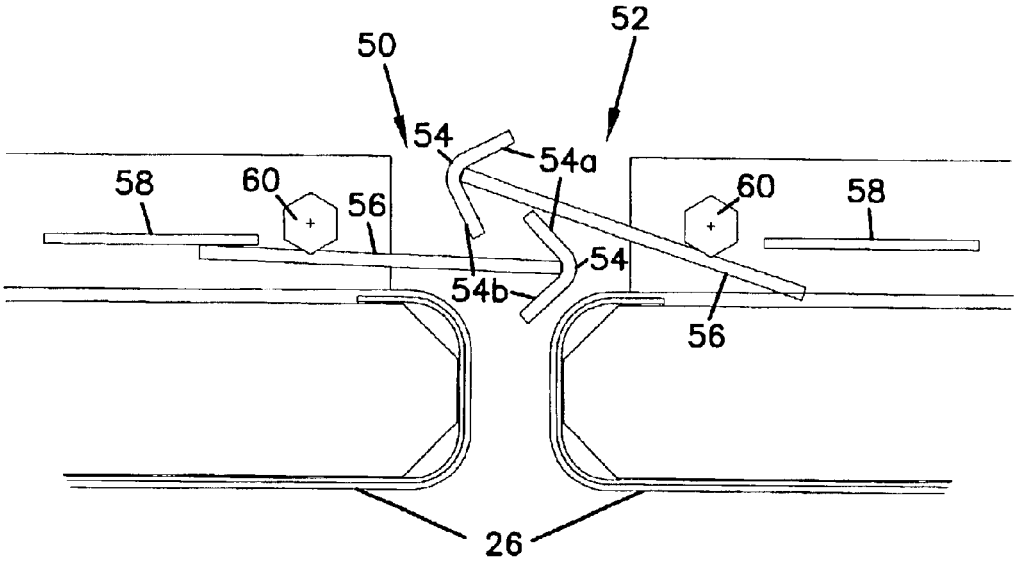
FIG. 9 is a detail view of the bench lock shown in FIG. 8 with the benches folded on the table an the second engagement member covering the first engagement member.
Figure 10:
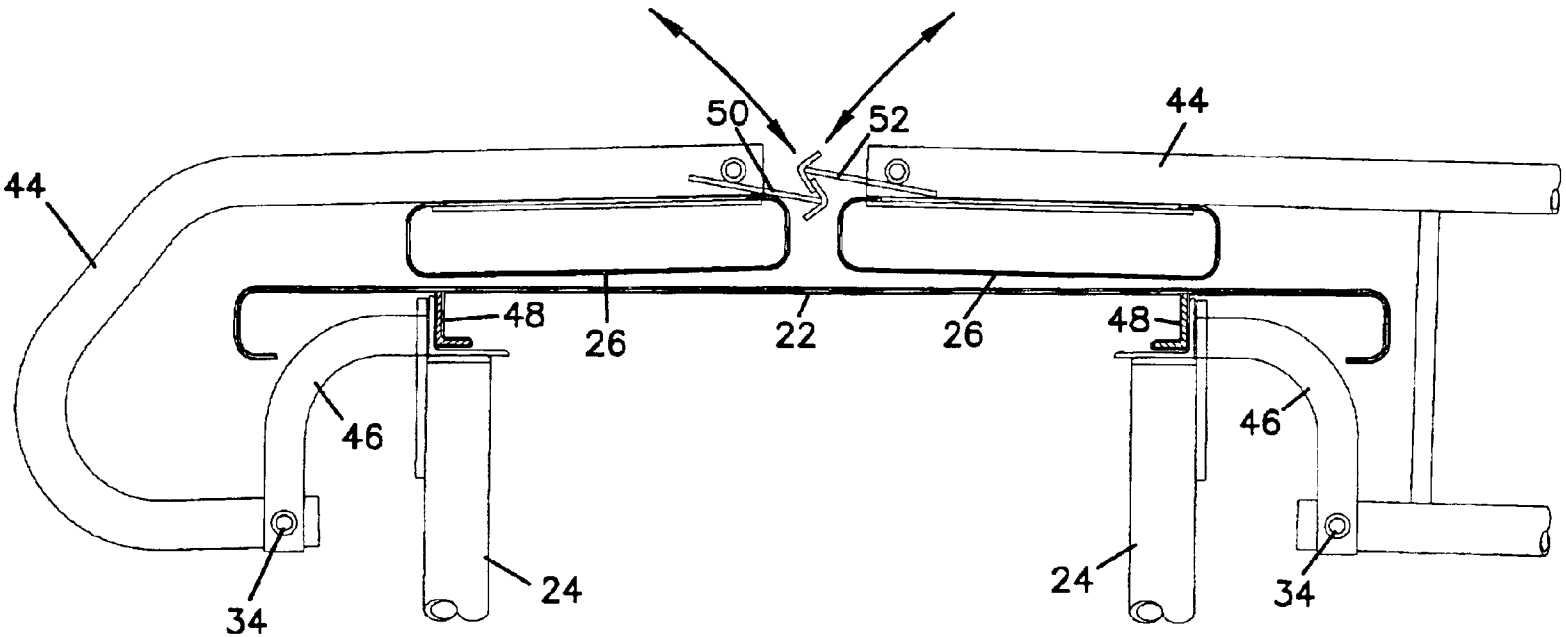
FIG. 10 is a detail view of the bench lock shown in FIG. 8 with the table tilted and the engagement members hooked together.

Referring now to FIGS. 8–10, there are shown complementary bench lock assemblies, generally designated 50 and 52. The lock mechanisms 50 and 52 insure that the benches 26 do not fall off the tabletop 22 during the tipping operation, thereby increasing the utility of the table 20 as the benches 26 do not need to be held. In particular, the bench 26 having the caster assembly 28 mounted thereto may pivot back downward during the tipping operation without a retaining mechanism. In addition, maintaining the bench 26 against the tabletop insures that the caster assembly 28 does not pivot and fold back up during tipping.

The folding mechanism includes a first latch assembly 50 mounted to a first bench 26 and a second latch assembly 52 mounted to the other bench 26. Each of the latch assemblies 50 and 52 include an end engagement member 54 including an upper engagement finger 54(*a*) and a lower engagement finger 54(*b*). The upper engagement finger 54(*a*) is configured for engaging the lower engagement finger 54(*b*) of the other complementary latch assembly. The latch assemblies 50 and 52 also include pivots 60 and stops 58 that maintain proper orientation and help to insure automatic engagement and disengagement at the proper time during the tipping process. The latch assemblies 50 and 52 each include a body 56 that is offset from the pivot 60 to utilize gravity in aiding orientation of the latch assemblies 50 and 52 to and through engagement and disengagement.

The latch assemblies 50 and 52 automatically engage regardless of which bench 26 is first folded on to the tabletop 22. If the bench 26 with the caster assembly 28 is first folded onto the tabletop 22, the latch assemblies 50 and 52 are configured as shown in FIG. 8. When this folding sequence has occurred, latch assembly 52 extends outward below latch assembly 50. During the tipping process, the upper engagement finger 54(*a*) of latch assembly 52 engages the lower engagement finger 54(*b*) of latch assembly 50. With the latch assemblies 50 and 52 hooked, the benches 26 are not able to pivot from the tabletop 22.

In a similar manner, if the bench 26 that it not connected to the caster assembly 28 is first folded onto the tabletop 22, the latch assemblies 50 and 52 are positioned as shown in FIG. 9. With this sequence of folding, the latch assembly 50 is positioned below the latch assembly 52. The latch assembly 50 extends below the latch assembly 52 and the end of the latch assembly body 56 engages the stop 58. When the table 20 is tipped on edge, the benches 26 may tend to separate from the tabletop 22, the upper engagement finger 54 of latch assembly 50 will automatically engage the lower engagement finger 54 of latch assembly 52, as shown in FIG. 10. With this configuration, the benches 26 are retained substantially against the upper surface of the tabletop 22.

When the table 20 is tipped upward to the storage position shown in FIG. 3, the offset mounting of the latch bodies 56 on the pivots 60 allows the latch assemblies 50 and 52 to move to the position shown in FIG. 3 and automatically disengage. In addition, when the table is in the position shown in FIG. 2, the latch assemblies are adjacent one another, but the engagement portions 54 are automatically spaced apart and disengaged. This provides for unfolding the table 20 to the use position since the latch assemblies 50 and 52 are not engaged. This configuration also provides for folding of the benches 26 to the upper surface of the tabletop 22 as is commonly done for cleaning, without having to manually engage or disengage the latch assemblies 50 and 52. Moreover, when the table 20 is in the unfolded use position as shown in FIG. 1, the latch assemblies 50 and 52 hang downward recessed below the benches in an out of the way position so that users of the table will not contact the latch assemblies 50 and 52.

In operation, an unfolded table 20 will be configured as shown in FIG. 1. To fold the table 20 to the storage position shown in FIG. 3, the benches 26 are first folded onto the tabletop 22 as shown in FIG. 2. In this position, the frame lock 80 is in the engaged position as shown in FIG. 6. The latch assemblies 50 and 52 are positioned as shown in either FIG. 8 or FIG. 9, depending upon which bench 26 was first folded to the tabletop. The benches 26 may be moved back to their use position or the table may be tipped. To tip the table 20, a user generally holds the tabletop 22 along the edge opposite the tipping side. The table 20 is simply pushed and lifted to pivot about a lower corner of the frame 24 until the caster assembly 28 engages. The table 20 is then pushed through the remaining portion of the tipping operation so that the table 20 is supported on the casters 30. This is the same configuration as shown in FIG. 2, but with the table rotated 90 degrees to be supported on the casters 30. During the tipping operation, should the benches 26 want to separate from the tabletop and one another, the latch assemblies 50 and 52 automatically engage, as shown in FIG. 10. In addition, the frame locks 80 are automatically engaged.

When the table 20 is supported on the casters 30 as shown in FIG. 2, the frame lock 80 is automatically moved to the position shown in FIG. 7. At this position, the framework 24 may be folded from the extended position shown in FIG. 2, to the storage position shown in FIG. 3 substantially against the underside of the table 22. In addition, the latch assemblies 50 and 52 automatically disengage due to gravity, the offset mounting and the stops 58.

To unfold the table from the storage position shown in FIG. 3 back to the use position shown in FIG. 1, the framework 24 is unfolded to the position shown in FIG. 2. As the table 20 tips back to the use position, the frame lock 80 engages the legs to prevent the framework from accidentally collapsing and the lower bench automatically pivots into the use position. Tipping continues by lowering the table 20 until it is fully supported by the frame with the tabletop in the horizontal use position. At this position, the leg lock 80 is fully engaged as shown in FIG. 6. The bench 26 without the caster assembly simply folds back from the position shown in FIG. 2 to the use position shown in FIG. 1. The latch assemblies 50 and 52 then are automatically positioned out of the way below their respective benches 26 and the table 20 is fully ready for use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding table comprising:

a frame including folding legs;

a tabletop;

a first seating structure supported by the frame and pivotally mounted along a first side of the tabletop and a second seating structure supported by the frame and pivotally mounted along a second opposite side of the tabletop;

a locking device, automatically locking the seating structures to the tabletop at a partially tipped position, and automatically releasing the legs when the table is tipped to a storage position, wherein the locking device comprises complementary pivoting first and second hooks configured and arranged to engage one another when the locking device engages.

2. A folding picnic table according to claim 1, further comprising a caster assembly.

3. A folding picnic table according to claim 1, wherein the first hook extends in a first direction and the second hook extends in a second direction.

4. A folding picnic table according to claim 1, wherein the first and second hooks are opposed to facilitate automatic engagement of the hook members.

5. A folding picnic table a frame including folding less;

a tabletop;

a first seating structure supported by the frame and pivotally mounted along a first side of the tabletop and a second seating structure supported by the frame and pivotally mounted along a second opposite side of the tabletop;

a locking device, automatically locking the seating structures to the tabletop at a partially tipped position, and automatically releasing the legs when the table is tipped to a storage position, wherein the locking device comprises opposed complementary first and second engagement devices to facilitate automatic engagement of the engagement device wherein the engagement devices are pivotally mounted, and wherein each of the engagement devices comprises a first hook extending in a first direction and a second hook extending in a second direction.

6. A folding picnic table a frame including folding legs;

a tabletop;

a first seating structure supported by the frame and pivotally mounted along a first side of the tabletop and a second seating structure supported by the frame and pivotally mounted along a second opposite side of the tabletop;

a locking device, automatically locking the seating structures to the tabletop at a partially tipped position, and automatically releasing the legs when the table is tipped to a storage position, wherein the locking device comprises opposed complementary first and second engagement devices to facilitate automatic engagement of the engagement devices wherein each of the engagement devices is offset from its pivoting axis so as to hang at a position wherein the engagement devices disengage when the picnic table is tipped, and wherein each of the engagement devices comprises a first hook extending in a first direction and a second hook extending in a second direction.

7. A folding picnic table according to claim 2, wherein the frame is configured to tip the table to one side to a storage position wherein the table is supported on the casters.

8. A folding picnic table according to claim 1, wherein the table pivots about a corner of the frame during tipping.

9. A folding picnic table having an unfolded use position and a folded storage position with the table tipped on one side for storage, comprising:

a tabletop;

legs folding from a use position to a storage position against an underside of the tabletop;

folding benches mounted to the tabletop and folding between a storage position on the tabletop and a use position wherein the benches are supported by the legs;

a first lock comprising a plate pivotally mounted to the tabletop and automatically engaging the legs in the use position and disengaging the legs when the table is tipped on one side.

10. A folding picnic table according to claim 9, wherein the plate engages one of the legs in the use position and automatically disengages the legs when the table is tipped to one side.

11. A folding table configured for tipping to a first side, comprising:

a frame;

a tabletop mounted to the frame;

a first seating structure and a second seating structure pivotally mounted to the frame;

folding legs mounted to the frame and supporting the first and second seating structures;

a first locking device, automatically locking the folding legs relative to the tabletop at an unfolded position; and releasing the legs when tipped to the first side; and a pivotally mounted second locking device, automatically locking the seating structures to the tabletop at a partially tipped position.

12. A folding table configured for tipping to a first side, comprising:

a frame;

a tabletop mounted to the frame;

a seating structure mounted to the frame;

folding legs mounted to the frame and supporting the seating structure; and a locking device comprising a plate pivotally mounted to the tabletop and automatically engaging the legs in the use position and disengaging the legs when the table is tipped on one side.

* * * * *

UNITED STATES PATENT AND TRADEMARK OFFICE

CERTIFICATE OF CORRECTION

PATENT NO. : 6,772,699 B1
APPLICATION NO. : 10/437724
DATED : August 10, 2004
INVENTOR(S) : John M. Elliott It is certified that error appears in the above-identified patent and that said Letters Patent is hereby corrected as shown below:

Front Page, (56) References
Cited, U.S. Patent Documents: insert --

| | | |
|---|---|---|
| 2,702,585 | 2/1955 | Wilson |
| 3,174,796 | 3/1965 | Brown |
| 3,276,815 | 10/1966 | Cardy |
| 4,932,333 | 6/1990 | Jensen et al.-- |

Claim 5, col. 6, line 64: "folding less" should read --folding legs--

Claim 5, col. 7, line 10: "device wherein" should read --device, wherein--

Claim 6, col. 7, line 30: "devices wherein" should read --devices, wherein--

Signed and Sealed this

First Day of May, 2007

JON W. DUDAS
*Director of the United States Patent and Trademark Office*